United States Patent [19]

Howald

[11] 4,441,993

[45] Apr. 10, 1984

[54] FLOTATION PROCESS

[75] Inventor: Frank P. Howald, Sunnyvale, Calif.

[73] Assignee: Fluor Corporation, Irvine, Calif.

[21] Appl. No.: 35,634

[22] Filed: May 3, 1979

Related U.S. Application Data

[63] Continuation of Ser. No. 627,949, Nov. 3, 1975, abandoned.

[51] Int. Cl.[3] ..... B03B 1/00

[52] U.S. Cl. ..... 209/5; 209/166; 209/167; 209/170; 423/1; 423/29; 423/53; 423/69; 423/51; 423/127; 423/146; 423/106; 423/162; 423/163; 423/38; 423/41; 423/17; 423/20

[58] Field of Search ..... 209/166, 167, 164, 3, 209/5, 170; 210/705, 221.2, 661; 423/167, 302, 321.1, 29, 53, 69, 51, 127, 146, 106, 162, 163, 38, 41, 17, 20

[56] References Cited

U.S. PATENT DOCUMENTS

| | | | |
|---|---|---|---|
| Re. 28,323 | 1/1975 | Silva . | |
| 708,494 | 9/1902 | Randall | 210/255 X |
| 1,203,372 | 10/1916 | Lyster | 209/167 |
| 1,226,330 | 5/1917 | Haultain | 209/167 |
| 1,886,779 | 11/1932 | Ruth | 209/166 |
| 2,569,680 | 10/1951 | Leek . | |
| 2,923,408 | 2/1960 | Williams . | |
| 3,048,272 | 8/1962 | Miller | 209/166 |
| 3,054,746 | 9/1962 | Gaden | 209/166 X |
| 3,137,650 | 6/1964 | Smith et al. . | |
| 3,240,556 | 3/1966 | Bhappu | 209/166 X |
| 3,259,237 | 7/1966 | Schoeld . | |
| 3,292,780 | 12/1966 | Frommer et al. . | |
| 3,307,790 | 3/1967 | Cohn | 209/3 X |
| 3,314,880 | 4/1967 | Rubin . | |
| 3,339,730 | 9/1967 | Boutin et al. . | |
| 3,418,236 | 12/1968 | Mail . | |
| 3,451,788 | 6/1969 | Smith . | |
| 3,456,790 | 7/1969 | Fast et al. . | |
| 3,545,941 | 12/1970 | Wilson . | |
| 3,589,622 | 6/1971 | Weston . | |
| 3,667,690 | 6/1972 | Weston . | |
| 3,696,922 | 10/1972 | Weston . | |
| 3,710,934 | 1/1973 | Wyman . | |
| 3,711,032 | 1/1973 | Weston . | |
| 3,735,931 | 5/1973 | Weston | 209/166 X |
| 3,746,265 | 7/1973 | Dancy . | |
| 3,782,546 | 1/1974 | Kirwin et al. . | |
| 3,802,632 | 4/1974 | Dancy . | |
| 3,805,951 | 4/1974 | Brogoitti et al. . | |
| 3,909,287 | 9/1975 | Randell | 210/705 X |
| 3,964,997 | 6/1976 | Weston | 209/166 |
| 4,043,760 | 8/1977 | Hiatt | 75/1 R X |

FOREIGN PATENT DOCUMENTS

| | | |
|---|---|---|
| 52835 | 9/1974 | Australia . |
| 48-26572 | 8/1973 | Japan . |
| 49-74607 | 7/1974 | Japan . |
| 49-81217 | 8/1974 | Japan . |
| 50-67716 | 6/1975 | Japan . |
| 50-131617 | 10/1975 | Japan . |
| 1028741 | 5/1966 | United Kingdom . |
| 1361767 | 7/1974 | United Kingdom . |
| 1375055 | 11/1974 | United Kingdom . |

OTHER PUBLICATIONS

Hackh, Chem. Dictionary, McGraw-Hill, 1944 Third Edition, pp. 208, 241-243, 385, 772-775, 881, 208, 569-571.

Handbook of Chem. & Physics, 31 Edition, 1949, pp. 432-543.

R. A. Wyman, "The Floatability of Twenty-One Non-Metallic Minerals," Technical Bulletin TB 108, Mineral Processing Div., Dept. of Energy, Mines & Resources, Mines Branch, Ottawa, Canada (Jan. 1969).

R. J. Woody, "Graphical Representation of Theoretical Solution Losses by CCD," Paper presented at Annual Meeting of American Institute of Mining, Metallurgical, and Petroleum Engineers, New York (Feb. 17-20, 1958).

W. P. Wilson, "Separation of Clay Slimes in Soluble Salt Processing," Paper presented at the AIME Mineral Meeting, Pacific Grove, California (May 1967).

A. I. Vogel, Qualitative Chemical Analysis, Longmans, Green & Co., London (1948), pp. 362-365.

A. F. Taggart, Handbook of Mineral Dressing, 5th Edition, John Wiley & Sons, Inc., New York (1953) Section 2, pp. 102-103.

Flotation Column Due for Mill Scale Tests, Engineering and Mining Journal, vol. 166, No. 1 (1965), pp. 76–83.
C. R. Hayward, an Outline of Metallurgical Practice (1952), Figures 277, 278, 299, found between pp. 445 and 465.

*Primary Examiner*—Bernard Nozick
*Attorney, Agent, or Firm*—Lyon & Lyon

[57] ABSTRACT

A process for recovering metallic values by putting the values into solution and separating undesired mineral matter from the solution using countercurrent flotation is provided. The process involves leaching metallic values from host rock, conditioning the resultant ore pulp with the required reagents to achieve selective flotation of mineral matter in the metallic values solution, introducing the conditioned ore pulp into flotation cells, along with counterflow of solution from an immediately subsequent flotation step, wherein simultaneous washing and flotation is achieved, and the mineral matter is removed leaving a solution of the metallic values. The resultant mineral matter froth product is subjected to subsequent stages of flotation and simultaneous washing with counterflow of solution removed from each subsequent stage of flotation, water and/or barren solution being used for washing in the final flotation stage. The addition of water and/or barren solution to the final stage is controlled to maintain the desired concentrations of the advancing solutions.

8 Claims, 4 Drawing Figures

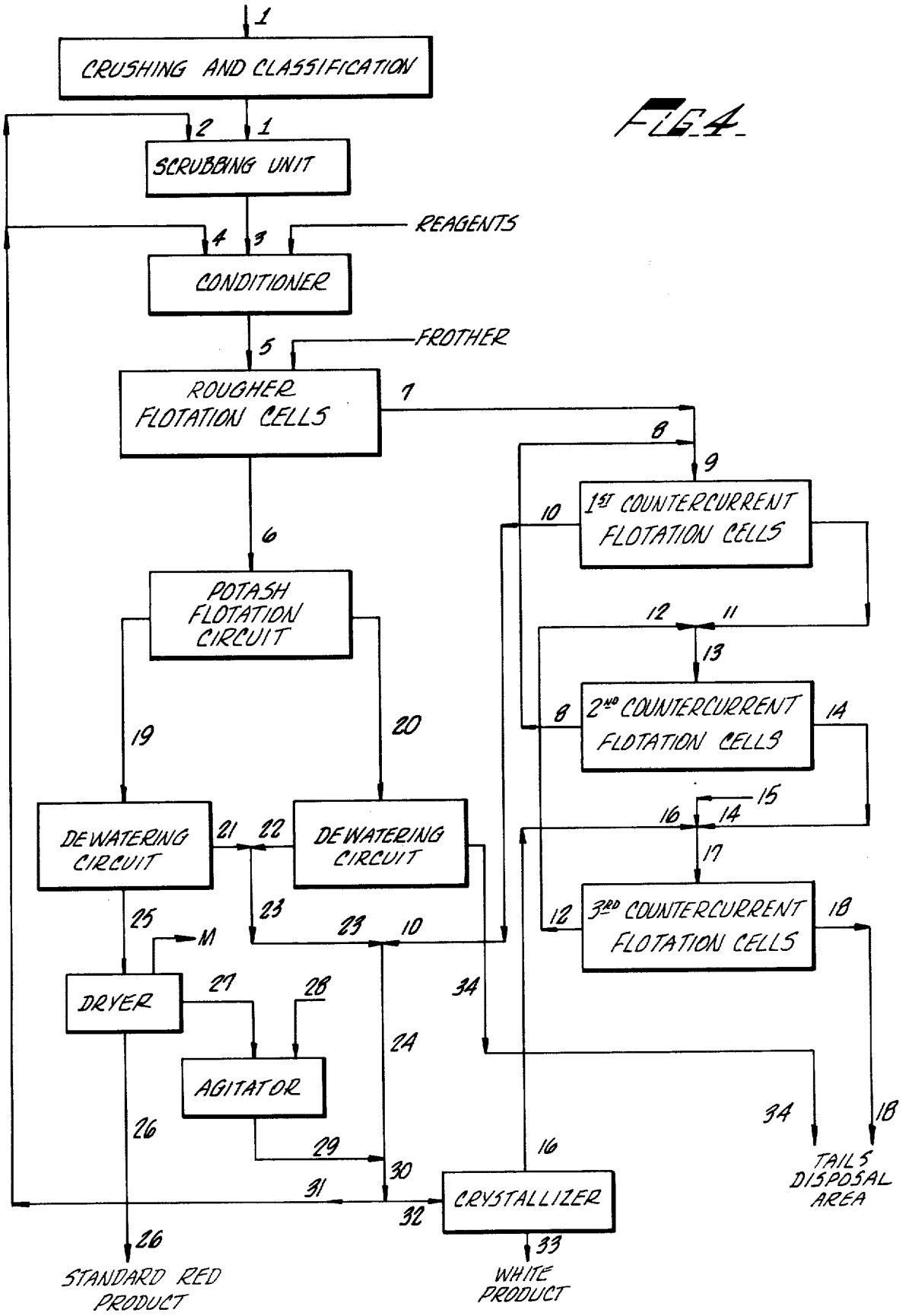
FIG. 4
CRUSHING AND CLASSIFICATION
SCRUBBING UNIT
REAGENTS
CONDITIONER
FROTHER
ROUGHER FLOTATION CELLS
1ST COUNTERCURRENT FLOTATION CELLS
POTASH FLOTATION CIRCUIT
2ND COUNTERCURRENT FLOTATION CELLS
DEWATERING CIRCUIT
DEWATERING CIRCUIT
3RD COUNTERCURRENT FLOTATION CELLS
DRYER
AGITATOR
CRYSTALLIZER
TAILS DISPOSAL AREA
STANDARD RED PRODUCT
WHITE PRODUCT

FLOTATION PROCESS

This is a continuation of application Ser. No. 627,949, filed Nov. 3, 1975 now abandoned.

BACKGROUND OF THE INVENTION

This invention relates to the hydrometallurgical processing of ores. More particularly, it relates to an improvement in processing ores hydrometallurgically whereby the recovery of desired values from the ores is substantially increased. Still more particularly, it relates to a novel procedure for separating mineral matter from ores containing metallic values whereby the loss of metallic values, normally encountered in solid-liquid separations, is substantially reduced.

For effective recovery of dissolved metallic values from solid mineral matter, it is conventional to make a series of liquid-solid separations following repetitive stages of washing of the solid phase with counterflow of solution removed from each subsequent stage of liquid-solid separation, washing being done with water and/or barren solution prior to the last stage. Barren solution is commonly known as the solution remaining after the metallic values have been recovered by processes such as precipitation or electrolytic separation. The most efficient methods to date have involved the application of one of the following equipment systems: countercurrent thickening circuits, self-cleaning filters or solid-bowl centrifuges. By these methods, however, a substantial amount, usually from about 8% to 15%, of metallic values is removed with the solid mineral matter. Frequently, with ores containing a high percentage of clays, fine silicate particles and the like, the percentage of metallic values removed with the mineral matter well exceeds 15%. This is because such constituents either absorb a relatively large amount of the metallic values solution and/or cannot be effectively washed and dewatered. When the foregoing methods are utilized, such constituents are generally separated with the solid mineral matter, carrying metallic values with them. The metallic values lost in the liquid-solid separation steps have not previously been economically available for recovery through subsequent processing.

In fact, separation of the dissolved metallic values from the undissolved mineral matter has meant extremely high capital costs and operating costs per daily ton of plant capacity. Further, a method of separating the dissolved metallic values may be incompatible with other processing steps. For example, in potash metallurgy, a continuous countercurrent decantation (CCD) thickening circuit is not economically combinable with amine flotation of mineral matter particles from particles of potash.

It is an object of the present invention to avoid the significant loss of metallic values associated with liquid-solid separations.

It is also an object of the present invention to provide a method of separating the dissolved metallic values from undissolved mineral matter which affords for lower capital costs per daily ton of plant capacity or, similarly, a higher recovery of metallic values for comparable capital costs per daily ton of plant capacity.

A further object of the present invention is to provide a method of separating dissolved metallic values from undissolved mineral matter which is economically combinable with other heretofore incompatible processing steps.

Another object of the present invention is to provide a process for recovering metallic values from mineral matter which affords better washing action through continuous agitation during separation, which cannot be achieved by conventional practices involving thickeners, centrifuges and/or filters.

Another object of the present invention is to provide a method of obtaining a better contact between particles bearing metallic values and solution through continuous agitation during separation, which affords a better opportunity for leaching the metallic values.

A further object of the present invention is to provide a process of obtaining metallic values from mineral matter which has a fewer number of washing and separation steps than utilized with conventional practices for equivalent yields.

SUMMARY OF THE INVENTION

With this invention, it has been found that the above objects can be achieved and the liquid-solid separation can be effected by a process in which metallic values are leached from host rock and the resultant pulped ore is conditioned with appropriate reagents, followed by froth flotation of the solid mineral matter, accompanied by simultaneous washing with counterflow of solution removed from an immediately subsequent flotation stage. The nonfloatable solution from this first flotation-washing step, referred to herein as 1st countercurrent tails, is further processed as required to recover the desired metallic values in the solution. To abstract the metallic values contained in the resultant mineral matter froth, the froth is subjected to a series of liquid-solid separations by flotation, accompanied by simultaneous washing with counterflow of solution removed from each subsequent stage of flotation, water and/or barren solution being used for washing in the last stage. Processing of the pulped ore in this manner is referred to as countercurrent flotation.

Often, it is the practice in the art to subject original ore pulp to preliminary classification steps, such as screening, cycloning and/or hydroseparating, whereby a major proportion of fine particles, or slimes, is separated from the coarse size fraction and either processed separately from the coarse mineral size fraction or discarded. However, if these slimes are treated by the process of this invention, a solution will be obtained containing practically all the soluble metallic values associated therewith, which may be substantially recovered by routing the solution to subsequent well known processing steps, such as precipitation or electrolytic separation.

Also, it is often the practice in the art to subject the mineral matter froth from a flotation process to cleaning by subsequent stages of flotation and grinding, if required, whereby the concentration of desired values is increased by rejection of unwanted mineral matter. If the resultant, rejected mineral matter from such cleaning is treated by the process of the invention, a solution will be obtained which contains practically all the soluble metallic values associated therewith, which may be substantially recovered by routing the solution to subsequent processing steps.

In addition, the mineral matter froth from a flotation process, mentioned above, could be directly treated with the process of this invention with substantially the same results being obtained in regard to the metallic values. This is also true for other mineral concentrates, such as those which are the products of other separation processes, including jigging, tabling, heavy media, magnetic separation, etc.

FIG. 4 is a flowsheet for the recovery of potash utilizing a conventional potash flotation recovery system accompanied by a countercurrent flotation system, with numerals designating streams described in detail in Example IV.

GENERAL PROCESS DESCRIPTION

Figure 1:
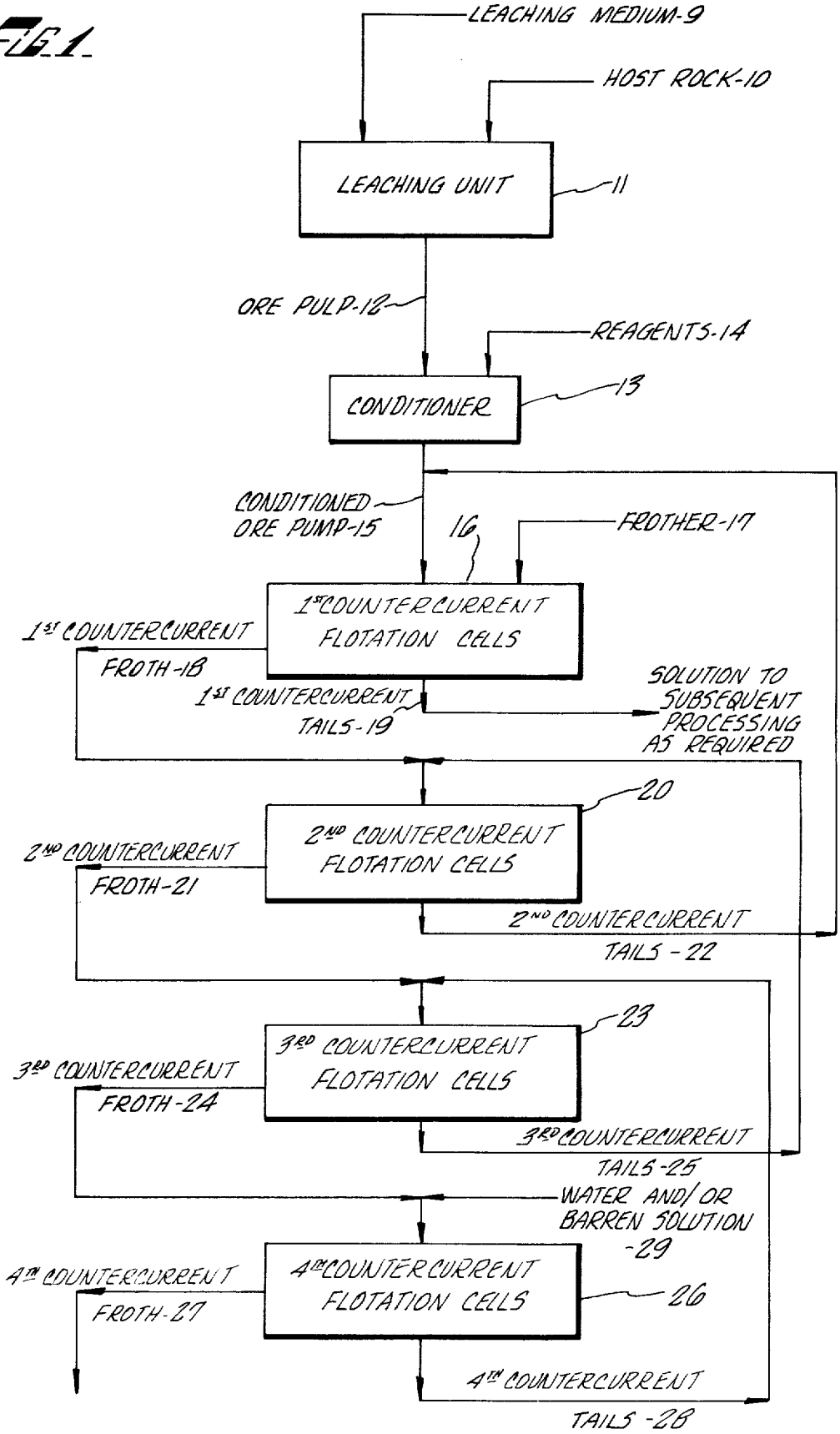
FIG. 1 is a flowsheet depicting a preferred embodiment of this invention, which is basically applicable to all soluble substances, although soluble metals and metallic compounds are of primary concern herein.

The process of the invention may be advantageously applied to either originally mined ore, a slimes fraction and/or particular size fraction obtained by classification, rejected mineral matter from the cleaning of flotation mineral matter froth, or a mineral concentrate generated from a separation process, such as jigging, tabling, heavy media, magnetic separation, flotation, etc.

Furthermore, the process of this invention can be adapted for use under varying circumstances. For example, countercurrent flotation can be applied to substantially any flow of slurry within a mineral processing facility, such as the slurry discharged from a leaching circuit. The leaching circuit may handle either crude ore or mineral concentrates. The only limitation might be the size consist or distribution of the mineral impurities and/or reaction products of the leaching, known as leach residue. In general, flotation is most effective when the top size of the mineral particles does not exceed 48 mesh, however, there are exceptions. For example, in the potash and phosphate industry, successful flotation has been achieved on particles as coarse as 8 mesh. This is also true for the flotation of coal and silicate minerals at various operating plants in the U.S. and Europe.

If the size of mineral particles in the slurry to countercurrent flotation must be regulated to meet specific process requirements, such regulations may be achieved by utilizing apparatus such as screens, classifiers, cyclones, centrifuges, thickeners, etc. For example, if circumstances require, cyclones may be used to separate plus 65 mesh material from minus 65 mesh particles, with the fine fraction being processed through a countercurrent flotation circuit. Likewise, overflow from a thickener (minus 400 mesh), effluent from a centrifuge (minus 200 mesh), filtrate from a filter (minus 150 mesh), underflow from a thickener (minus 65 mesh), etc. may be routed to a countercurrent flotation circuit in appropriate situations.

The Metallic Values

This invention may be applied to any desired values, elements or compounds, which can be dissolved in the presence of insoluble impurities, although metallic values which can be so dissolved are of primary interest. Illustrative examples of specific metallic values recoverable by the process of the instant invention, along with representative leaching mediums, are as follows:

| METALLIC VALUE | LEACHING MEDIUMS |
|---|---|
| Potassium | Water |
| Sodium | Water |
| Magnesium | Water |
| Lithium | Water |
| Boron | Water |
| Copper | Aqueous Solution of Sulfuric Acid, Hydrochloric Acid or Ferric Chloride |
| Uranium | Aqueous Solution of sulfuric Acid or Sodium Carbonate and Sodium Bicarbonate |
| Gold | Aqueous Solution of Sodium Cyanide |
| Silver | Aqueous Solution of Sodium Cyanide Sodium Hypochlorite or Potassium Hypochlorite |
| Nickel | Aqueous Solution of Ammonia or Ammonium Carbonate |
| Cobalt | Aqueous Solution of Sulfuric Acid |
| Zinc | Aqueous Solution of Sulfuric Acid |
| Aluminum | Aqueous Solution of Sodium Hydroxide |
| Phosphate | Aqueous Solution of Sulfuric Acid |
| Tungsten | Aqueous Solution of Hydrochloric Acid |
| Titanium | Aqueous Solution of Sulfuric Acid or Hydrochloric Acid |
| Antimony | Aqueous Solution of Sodium Sulfide or Hydrochloric Acid |
| Barium | Aqueous Solution of Hydrofluoric Acid or Nitric Acid |
| Rhenium | Aqueous Solution of Chlorine or Sodium Hypochlorite |

The Mineral Matter

The impurities typically separated from the metallic values by application of the instant invention are the insoluble constituents of the host rock with which the metallic values are associated and/or the insoluble reaction products of the leaching operation.

Flotation Reagents

The selection of flotation reagents to be used in the process of the instant invention depends on the constituents of the host rock associated with the desired metallic values. A report by R. A. Wyman, Head, Industrial Minerals Milling Section, Mineral Processing Division, Mines Branch, Department of Energy, Mines and Resources, Ottawa, Canada, entitled "The Floatability of Twenty-One Non-Metallic Minerals", incorporated herein by reference, gives illustrative reagent selections for 21 minerals.

The reagents, mentioned above, with which the pulped ore is conditioned normally include collectors and modifiers.

Collectors are agents which render the surfaces of minerals to be floated hydrophobic, i.e. lacking affinity for water, thus allowing attachment to an air bubble and elevation to the surface. The chemicals involved are the so-called surface-active agents, or surfactants.

In general, the collectors used for flotation of insoluble impurities in the process of this invention would be either oils, cationic organic hydrocarbons, anionic hydrocarbons or combinations thereof. Normally, neither alcohols, such as ethanol, nor inorganic salts would be suitable as collectors.

Exemplary collectors are:

1. "Green acid"-type petroleum sulphonate
2. Sodium alkyl-aryl petroleum sulphonic acid
3. Naphthalene sulphonic acid derivative
4. Fatty acid aliphatic sulphonate
5. Sulphonated castor oil (60% fats)
6. Sulphonated fatty acids 7. Sodium octyl sulphate
8. Sodium lauryl sulphate
9. Diethyl cyclohexylamine lauryl sulphate
10. Sodium-N-methyl-N-tallow acid taurate
11. Sodium-N-methyl-N-oleoyl taurate
12. Technical tallow amine acetate
13. Coco amine acetate
14. Primary beta amine
15. Tallow diamine di-acetate
16. Coco diamine di-acetate
17. Beta diamine
18. Hydroxyethyl alkyl imidazoline (glyoxalidine)
19. Lauryl amine
20. Beta tertiary amine
21. N(lauryl-colamino-formyl-methyl) pyridinium chloride
22. n-alkyl trimethyl ammonium chloride
23. Cetyl trimethyl ammonium bromide
24. Cetyl trimethyl benzyl ammonium chloride
25. Tall oil base fatty acid
26. Tall oil fatty acid
27. Oleic acid blend
28. Oleic acid Those familiar with flotation processes are well aware of considerations given to selection of a suitable collector. Thus, none of the 21 minerals evaluated in the Mine's Branch report would respond favorably to flotation using the following collectors:

Xanthates
Thiocarbamates
Dithiosphosphates
Thiocarbanilide
Xanthogen.

However, if sulfide minerals were present in the host rock, those skilled in the art would recognize that the above collectors would be used in combination with others.

Modifiers are agents which are capable of performing many functions. Such agents may be utilized to aid in getting the collector onto the surface of the mineral to be floated, an action called activation. On the other hand, modifying agents may be employed to prevent a collector from getting onto the surface of unwanted minerals, an action called depression. The former use is that to which modifiers are normally put in accordance with the process of the present invention.

In addition, modifiers may be used for pH regulation, the cleaning of mineral particle surfaces, dispersion of ultra-fine solids or precipitation of dissolved salts. Some modifiers may even serve more than one purpose, e.g., sodium carbonate may act as an activator, depressant, pH regulator or dispersant.

The modifiers used for flotation in accordance with the process of the present invention generally include all flotation reagents whose principal function is neither collecting nor frothing.

Exemplary modifiers are $H_2SO_4$, $Na_2CO_3$, $FeSO_4$, $AL(SO_4)_3$, HF, starch, dextrin and citric acid.

In commercial flotation practices, the addition of frothers is normally required to promote the formation of froth capable of supporting mineral-laden bubbles on the surface of the slurry or solution within the flotation cells. Frothers accomplish this objective by imparting temporary toughness to the covering film of the bubble and lowering the surface tension of the water. Customarily added into the feedboxes of the flotation cells, frothers conventionally used are organic heteropolar compounds such as glycol, hexanol, methyl isobutyl carbonol, terpenol, mixed capryl alcohol, and cresylic acid.

Operating parameters for the process of the present invention such as flow rates, recycle ratios, degree of agitation, etc. are discussed below.

Flow Rates

In practicing the process of the present invention, flow rates are readily determinable by those skilled in the art by a consideration of the following well known factors:

(a) design capacity of a particular facility;
(b) time required for separation of solids by flotation from the solution involved;
(c) percent solids of the feed slurry required for flotation;
(d) specific gravity of solution and solids; and
(e) size of the flotation cells used.

Hydrometallurgical plants have ranged in daily production capacity from several tons to over 15,000 tons.

Flotation time and percent solids in the feed are interdependent and are established by the flotation characteristics of the solids. Both variables may range widely from one type of ore to another. Flotation time may vary from about 1 to over about 30 minutes. Solids concentration may vary from about 10 to about 50 percent.

Recycle Ratios

An excellent reference for recycle ratios and the number of washing stages required is a paper by R. J. Woody entitled "Geographical Representation of Theoretical Soluble Losses by CCD", incorporated herein by reference.

Although this paper is related to thickeners, the same principles apply to countercurrent flotation. It is expected, however, that either the number of wash stages or volume of wash solution would be less than required using a CCD thickening circuit. Generally, the number of washing stages may vary between one and about eight and the recycle ratio, expressed as $$r = \frac{\text{liquid volume of solution } (W)}{\text{liquid volume in froth product } (D)},$$

may range between one and about six.

Degree of Agitation

The degree of agitation would be that utilized in currently practiced flotation processes, well known to those skilled in the art, for comparable particle size, tank volume, etc.

Other Important Variables

One other important variable is process temperature. In certain leaching operations, the temperature may be elevated to accelerate reaction rates. For flotation of various minerals, results are improved by heating the feed slurry. Temperatures for the process of invention could range from about 0° C. to about 105° C.

Another variable is pressure. Pressure may be used in some flotation processes to induce air rather than mechanical agitation. For example, in one pressure flotation cell, the Eimco's Flotator vessel, the feed slurry is introduced at a pressure between 15 and 60 psi. By sudden pressure release, a mild aeration results which promotes the formation of a mineral froth at the surface of the vessel.

Referring to FIG. 1, which depicts a preferred embodiment of the present invention, usually after approximate grinding and classification, host rock 10 containing the desired metallic values and mineral matter impurities is introduced into a leaching unit 11 concurrently with a leaching medium 9. (The leaching medium or a portion thereof may be introduced during grinding and classification.) Ore pulp 12, containing a metallic values solution and solid mineral matter impurities, is drawn from the leaching vat 11 and introduced into a conditioner 13, along with selected reagents 14 comprising conditioners and/or modifiers. The conditioned ore pulp 15 is then introduced into 1st countercurrent flotation cells 16, along with a frother 17 and a stream from a subsequent flotation step for washing the conditioned ore pulp 15, as will be discussed below. This mixture is agitated in the 1st countercurrent flotation cells 16 to facilitate simultaneous washing and flotation.

Mineral froth, called 1st countercurrent froth 18 herein, then floats to the top of the 1st countercurrent flotation cells 16, leaving a solution of the desired metallic values. This solution, the 1st countercurrent tails 19 herein, is taken from the approximate bottom of the 1st countercurrent flotation cells 16 and directed to subsequent processing for extraction of the desired metallic values.

The 1st countercurrent froth 18, on the other hand, is taken from the top of the 1st countercurrent flotation cells 16 and introduced into 2nd countercurrent flotation cells 20 along with countercurrent tails from a subsequent countercurrent flotation step (as will be discussed below) for washing and flotation. Here they are agitated by means of impellers and/or air injection, as with the 1st countercurrent flotation cells 16, and 2nd countercurrent froth 21 raises to the top of the cells, leaving a solution containing the desired metallic values, i.e. 2nd countercurrent tails 22. This solution, which is taken from the approximate bottom of the 2nd countercurrent flotation cells 20, is the stream referred to above that is introduced into the 1st countercurrent flotation cells 16, along with the conditioned ore pulp, for washing and flotation.

The 2nd countercurrent froth 21 is taken from the top of the 2nd countercurrent flotation cells 20 and introduced into 3rd countercurrent flotation cells 23 concurrently with countercurrent tails from a subsequent countercurrent flotation step (as will be discussed below) for washing and flotation. Here they are agitated as described above for the 1st and 2nd countercurrent flotation cells with 3rd countercurrent froth 24 rising to the top, leaving a metallic values solution, i.e. 3rd countercurrent tails 25. It is this solution that is used to wash the mineral froth 18 in the 2nd countercurrent flotation cells 20.

The 3rd countercurrent froth 24 taken from this step is introduced into 4th countercurrent flotation cells 26 along with water and/or barren solution 29 for washing and flotation. Again, they are subjected to agitation with 4th countercurrent froth 27 rising to the top, leaving the 4th countercurrent tails 28, which are used for washing the 2nd countercurrent froth 21.

The 4th countercurrent froth 27 which is taken from this step has had substantially all of the desired metallic values removed therefrom by the process just described and can be discarded or utilized for purposes apparent to those skilled in the art.

It should be noted in regard to the process just described that the number of flotation steps utilized is optional. One flotation step may be utilized or more, depending upon the total yield of metallic values desired. In general, the more steps that are utilized, the greater the total yield will be. However, a point will be reached where the utilization of additional flotation steps will cause such a small increase in the total yield that it will normally be impractical to make such an addition. In the case of the utilization of one flotation step, the addition of water and/or barren solution is not necessary, since impurities may be flotated in the metallic values solution generated in the leaching step.

Nonetheless, when more than one flotation step is utilized, water and/or barren solution may be utilized in conjunction with countercurrent tails for washing in flotation steps prior to the last, and a portion of the 1st countercurrent tails stream, described above as going to subsequent processing, may be used for washing in the last flotation stage.

It should be further noted that the water and/or barren solution which is used for washing may be controlled to maintain desired concentrations of advancing solutions in order to optimize recovery of the desired metallic values.

The invention is further illustrated by the examples which follow.

EXAMPLE I

The ore to be treated is found in a deposit which contains malachite, azurite and chrysocolla as copper values with the host rock comprising diorite. A diorite usually contains plagioclase, quartz, hornblende, biotite and pyroxene. The diorite constituents constitute the mineral matter impurities, while the copper values are the desired metallic values.

Material from the deposit is mined, then crushed and ground to a particle size to accommodate successful leaching of the copper minerals with an aqueous solution of sulfuric acid.

After leaching, countercurrent flotation is applied either to the entire flow of slurry (solids, dissolved copper acid solution) or a portion of the flow (a fine solids size fraction) obtained by use of mechanical classifiers, cyclones and/or dewatering.

The pH for flotation is established by use of sulfuric acid for leaching. Consequently, reagent selection must be based on response to an acid circuit.

A tabulation based on the aforementioned Mine's Branch report shows the following for acid circuit flotation of the minerals present in diorite:

| Mineral | Collector Section | Modifiers |
|---|---|---|
| Plagioclase (response similar to orthoclase) | Tertiary Amine | Citric Acid |
| Quartz | Tertiary Amine | Citric Acid |
| Hornblende | Diamine | Fluorine |
| Biotite | Tertiary Amine | Citric Acid |
| Pyroxene (response similar to hornblende) | Diamine | Fluorine |

Based on the above tabulation, the selected reagent schedule would include use of two amines, tertiary amine and diamine, as collectors, with either a combination of two modifiers, citric and hydrofluoric acid, or just one, citric acid. The frother could be selected from well known frothers for such systems including an alcohol, a glycol, a surfactant or a combination thereof.

In addition, the reagent combination which includes a polyacrylamide flocculant as modifier and an ethanolated alkyl guanidineamine complex as collector could most probably be employed for diorite, since this combination appears to behave as a universal reagent combination.

EXAMPLE II

As in Example I, the host rock is diorite, but the metallic value is gold. After crushing and grinding, the gold would be leached with an aqueous solution of cyanide, using lime to maintain a basic pH. Under these circumstances, the pH for flotation is basic. Consequently, reagent selection must be made accordingly. Based on the Mine's Branch Report, the reagent schedule would include use of a primary amine as the collector with additions of iron and aluminum sulfates as modifiers. The frother should be either an alcohol, a glycol, a surfactant or a combination thereof.

As in Example I, the reagent combination including a polyacrylamide flocculant and an ethanolated alkyl guanidineamine complex might also be employed here.

EXAMPLE III

Figure 2:
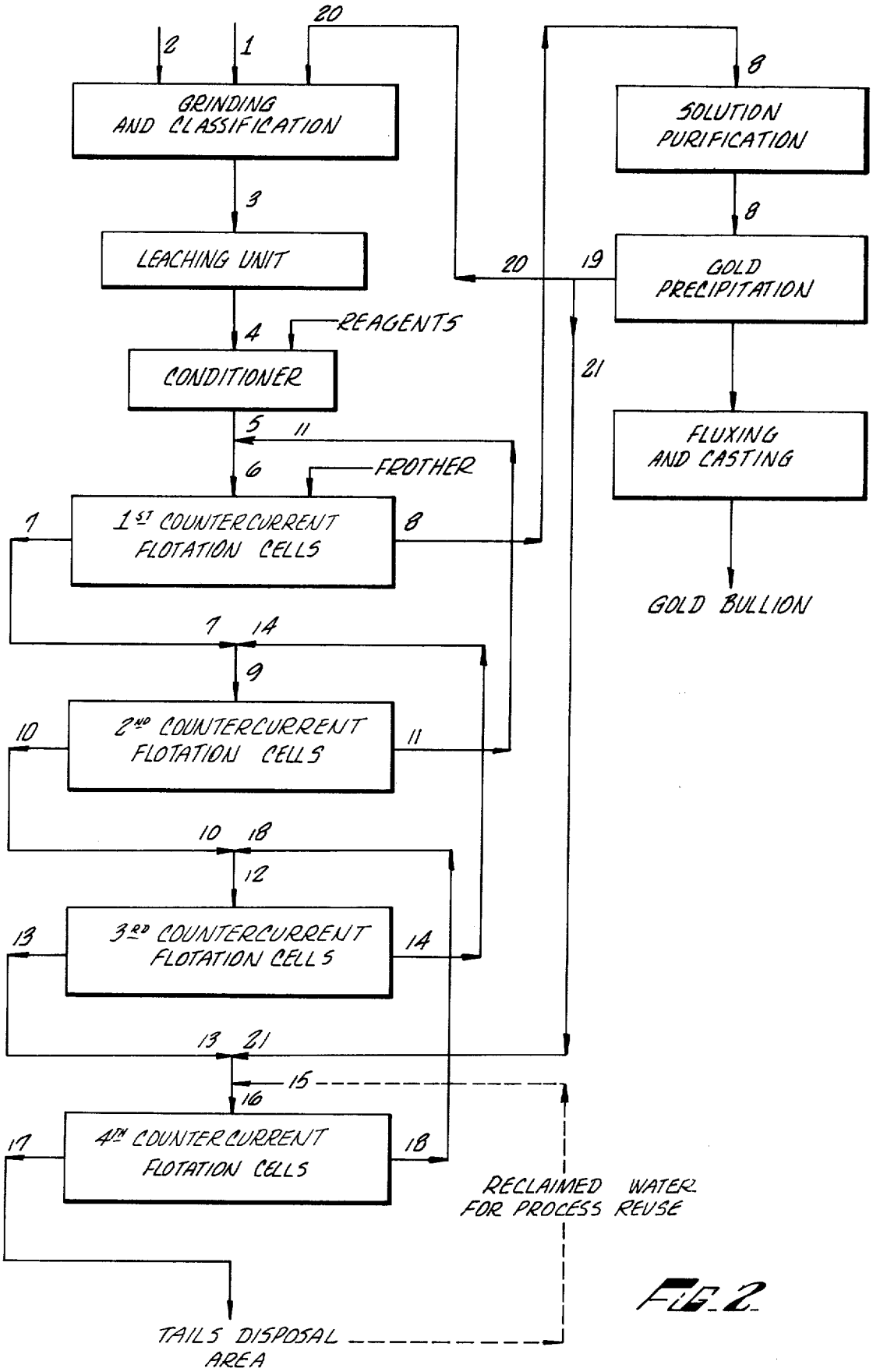
FIG. 2 is a flowsheet for the recovery of gold according to the instant invention, with numerals designating streams described in detail in Example III.

FIG. 2 is a flowsheet for the recovery of gold according to the instant invention. The following are illustrative flow rates for such a process:

| UNIT OPERATION | TONS PER HOUR Solids | TONS PER HOUR Solution | PERCENT Solids | GALLONS PER MINUTE Solids | GALLONS PER MINUTE Solids | GALLONS PER MINUTE Pulp | SPECIFIC GRAVITY Pulp or Solution |
|---|---|---|---|---|---|---|---|
| Grinding & Classification | | | | | | | |
| Feed Streams | | | | | | | |
| (1) Host Rock | 475 | 25 | 95 | 717 | 100 | 817 | 2.45 |
| (2) Cyanide Solution | — | 2 | — | — | 8 | 8 | 1.08 |
| (20) Barren Solution | — | 176.6 | — | — | 706 | 706 | 1.00 |
| Discharge (3) | 475 | 203.6 | 70 | 717 | 814 | 1531 | 1.77 |
| Leaching & Conditioner (4) & (5) | 475 | 203.6 | 70 | 717 | 814 | 1531 | 1.77 |
| 1st Countercurrent Flotation Cells | | | | | | | |
| Feed Streams | | | | | | | |
| (5) Conditioner Discharge | 475 | 203.6 | 70 | 717 | 814 | 1531 | 1.77 |
| (11) 2nd Countercurrent Tails | — | 1696.5 | — | — | 6786 | 6786 | 1.00 |
| (6) Total Feed | 475 | 1900.0 | 20 | 717 | 7600 | 8317 | 1.14 |
| Products | | | | | | | |
| (7) 1st Countercurrent Froth | 475 | 882.1 | 35 | 717 | 3528 | 4245 | 1.28 |
| (8) 1st Countercurrent Tails | — | 1017.9 | — | — | 4072 | 4072 | 1.00 |
| 2nd Countercurrent Flotation Cells | | | | | | | |
| Feed Streams | | | | | | | |
| (7) 1st Countercurrent Froth | 475 | 882.1 | 35 | 717 | 3528 | 4245 | 1.28 |
| (14) 3rd Countercurrent Tails | — | 1696.4 | — | — | 6786 | 6786 | 1.00 |
| (9) Total Feed | 475 | 2578.5 | 13.5 | 717 | 10,314 | 11,031 | 1.11 |
| Products | | | | | | | |
| (10) 2nd Countercurrent Froth | 475 | 882.1 | 35 | 717 | 3528 | 4245 | 1.28 |
| (11) 2nd Countercurrent Tails | — | 1696.4 | — | — | 6786 | 6786 | 1.00 |
| 3rd Countercurrent Flotation Cells | | | | | | | |
| Feed Streams | | | | | | | |
| (10) 2nd Countercurrent Froth | 475 | 882.1 | 35 | 717 | 3528 | 4245 | 1.28 |
| (18) 4th Countercurrent Tails | — | 1696.4 | — | — | 6786 | 6786 | 1.00 |
| (12) Total Feed | 475 | 2578.5 | 13.5 | 717 | 10,314 | 11,031 | 1.11 |
| Products | | | | | | | |
| (13) 3rd Countercurrent Froth | 475 | 882.1 | 35 | 717 | 3528 | 4245 | 1.28 |
| (14) 3rd Countercurrent Tails | — | 1696.4 | — | — | 6736 | 6736 | 1.00 |
| 4th Countercurrent Flotation Cells | | | | | | | |
| Feed Streams | | | | | | | |
| (13) 3rd Countercurrent Froth | 475 | 882.1 | 35 | 717 | 3528 | 4245 | 1.28 |
| (21) Barren Solution | — | 841.3 | — | — | 3366 | 3366 | 1.00 |
| (15) Water | — | 855.1 | — | — | 3420 | 3420 | 1.00 |
| (16) Total Feed | 475 | 2578.5 | 13.5 | 717 | 10,314 | 11,031 | 1.11 |
| Products | | | | | | | |
| (17) 4th Countercurrent Froth | 475 | 882.1 | 35 | 717 | 3528 | 4245 | 1.28 |
| (18) 4th Countercurrent Tails | — | 1696.4 | 35 | — | 6786 | 6786 | 1.00 |
| Solution Purification & Gold Precipitation | | | | | | | |
| Feed Stream | | | | | | | |
| (8) 1st Countercurrent Tails | — | 1017.9 | — | — | 4072 | 4072 | 1.00 |
| Discharge | | | | | | | |
| (19) Barren Solution | — | 1017.9 | — | — | 4072 | 4072 | 1.00 |
| Barren Solution Distribution | | | | | | | |
| (20) Grinding & Classification | — | 176.6 | — | — | 706 | 706 | 1.00 |
| (21) 4th Countercurrent Flotation | — | 841.3 | — | — | 3366 | 3366 | 1.00 |

The process of the present invention is particularly adaptable for use with a conventional potash flotation recovery system. In such a system, flotation is utilized to separate solid potash particles, i.e. particles of KCl and miscellaneous potassium salts, from solid mineral matter particles. Unfortunately, substantial amounts of potash are entrained with the mineral matter particles which are thereby separated. The potash associated with this mineral matter portion has heretofore been considered economically unrecoverable. However, such is not the case when the process of the present invention is utilized.

Figure 3:
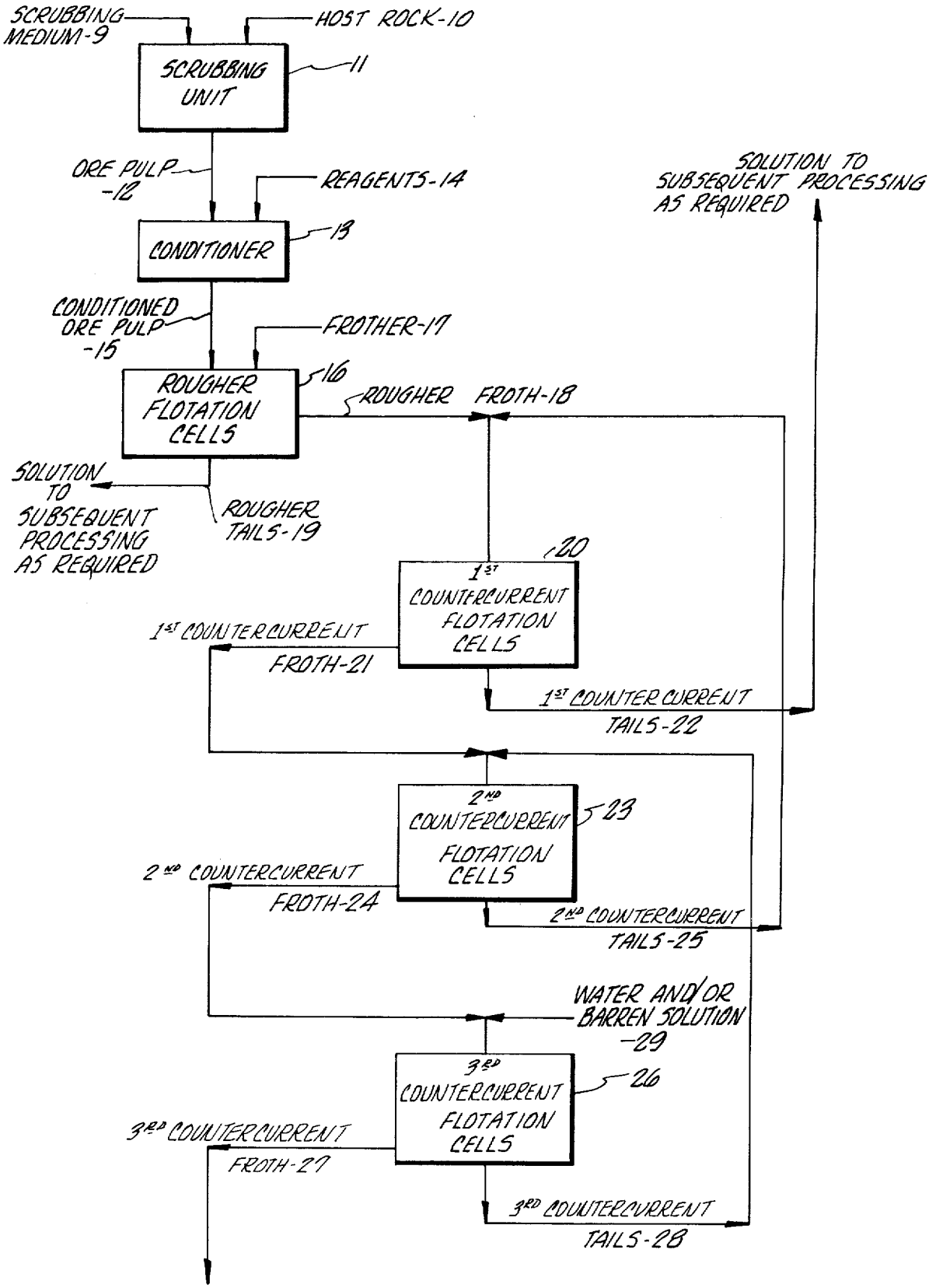
FIG. 3 is a flowsheet depicting a preferred embodiment of this invention as used in conjunction with a potash flotation circuit.

Referring to FIg. 3, which depicts a preferred embodiment of such a utilization, host rock 10 containing the desired potash values, as well as mineral matter impurities is, normally after crushing and classification, introduced into a scrubbing unit 11 concurrently with a scrubbing medium 9, such as saturated brine. Saturated brine is an aqueous solution containing the maximum amount of potash dissolved therein. The scrubbing unit 11 is used to attrition the potash particles thereby liberating mineral matter particles which are contained in the host rock 10. Unlike the process of the present invention in which a leaching medium is utilized to brine the desired values into solution, the conventional potash flotation recovery process utilizes scrubbing mediums, such as saturated brine, to keep potash values from going into solution so that a solid-solid separation can be made of the potash particles and the mineral matter particles in the initial flotation step of the process.

Scrubbing unit discharge 12, containing solid potash values and solid mineral matter particles is discharged from the scrubbing unit 11 and introduced into a conditioner 13, along with selected reagents 14 comprising modifiers and/or collectors, such as a polyacrylamide flocculant as a modifier and an ethanolated alkyl guanidineamine complex as a collector. Additional saturated brine may sometimes be added into conditioner 13 to reduce the percentage of solids therein and thereby facilitate the conditioning of scrubber discharge 12. The propriety of such addition depends upon the nature of the host rock 10 being processed and will be readily apparent to those skilled in the art. The conditioned scrubber discharge 15 is then introduced into rougher flotation cells 16, normally along with a frother 17, and agitated by impellers and/or air injection.

Rougher froth 18, including mineral matter particles and entrained potash particles, then floats to the top of the rougher flotation cells 16, leaving rougher tails 19, including saturated brine and solid potash particles. The rougher tails 19 are directed to subsequent processing for extraction of the desired potash values, while the rougher froth 18 is introduced into 1st countercurrent flotation cells 20, along with 2nd countercurrent tails 25 from 2nd countercurrent flotation cells 23. It should be noted that for the purposes of the process of the present invention, these 2nd countercurrent tails 25 become the initial leaching medium for the potash in rougher froth 18 and that usually no more reagents need be added to the rougher froth 18, since the particles therein have already been subjected to conditioning in conditioner 13. To achieve desired flotation results with some ores, however, introduction of additional amounts of reagents into selected countercurrent flotation cells may be required.

From this point on, countercurrent flotation is conducted just as described earlier. The 1st countercurrent tails 22 are directed to subsequent processing, while the 1st countercurrent froth 21 is introduced into 2nd countercurrent flotation cells 23, along with 3rd countercurrent tails 28 from 3rd countercurrent flotation cells 26, etc.

Although FIG. 3 depicts three countercurrent flotation stages, as was discussed earlier, more or less might be used, depending upon the yield of potash desired from the countercurrent flotation operation.

It should be noted that although the entire stream of 1st countercurrent tails 22 could be directed to a unit, such as a crystallizer, for the extraction of substantially all the potash therein, it is more advantageous to regulate the addition of water and/or barren solution to the last countercurrent flotation cells such that the 1st countercurrent tails 22 will be a saturated brine solution and then to combine this stream with other saturated brine streams which are normally generated in a conventional potash flotation recovery system. By doing this, sufficient saturated brine is made available for operation of the conventional potash recovery system without additional saturated brine having to be generated, and the saturated brine from these combined streams which is not needed for operation of the conventional potash recovery system may be routed to an appropriate extraction unit, such as a crystallizer, for the recovery of potash values therein. An illustration of such an arrangement is given in the following example.

EXAMPLE IV

FIG. 4 is a flowsheet for the recovery of potash according to the adaptation of the instant invention just discussed. The following are illustrative flow rates for such a process:

| | TONS PER HOUR | | PERCENT | GALLONS PER MINUTE | | | SPECIFIC GRAVITY |
|---|---|---|---|---|---|---|---|
| UNIT OPERATION | Solids | Solution | Solids | Solids | Solution | Pulp | Pulp or Solution |
| Scrubbing Unit | | | | | | | |
| Feed Streams | | | | | | | |
| (1) Potash Ore | 400 | 20 | 95 | 800 | 65 | 865 | 1.94 |
| (2) Brine | — | 151 | — | — | 487 | 487 | 1.24 |
| Discharge (3) | 400 | 171 | 70 | 800 | 552 | 1352 | 1.69 |
| Conditioner | | | | | | | |
| Feed Streams | | | | | | | |
| (3) Scrubbing Unit Discharge | 400 | 171 | 70 | 800 | 552 | 1352 | 1.69 |
| (4) Brine | — | 762 | — | — | 2458 | 2458 | 1.24 |
| Discharge (5) | 400 | 933 | 30 | 800 | 3010 | 3810 | 1.40 |
| Rougher Flotation Cells | | | | | | | |
| Feed Streams | | | | | | | |
| (5) Conditioner Discharge 400 | 933 | 30 | 800 | 3010 | 3810 | 1.40 | |
| Products | | | | | | | |
| (6) Rougher Tails | 366 | 627 | 36.8 | 732 | 2023 | 2755 | 1.44 |
| (7) Rougher Froth | 34 | 306 | 10 | 68 | 987 | 1055 | 1.29 |
| 1st Countercurrent Flotation Cells | | | | | | | |
| Feed Streams | | | | | | | |
| (7) Rougher Froth | 34 | 306 | 10 | 68 | 987 | 1055 | 1.29 |
| (8) 2nd Countercurrent Tails | — | 340 | — | — | 1104 | 1104 | 1.23 |
| (9) Total Feed | 34 | 646 | — | 68 | 2091 | 2159 | 1.26 |
| Products | | | | | | | |
| (10) 1st Countercurrent Tails | — | 375 | — | — | 1210 | 1210 | 1.24 |
| (11) 1st Countercurrent Froth | 32 | 273 | 10.5 | 64 | 881 | 945 | 1.29 |
| 2nd Countercurrent Flotation Cells | | | | | | | |
| Feed Streams | | | | | | | |

-continued

| UNIT OPERATION | TONS PER HOUR Solids | TONS PER HOUR Solution | PERCENT Solids | GALLONS PER MINUTE Solids | GALLONS PER MINUTE Solution | GALLONS PER MINUTE Pulp | SPECIFIC GRAVITY Pulp or Solution |
|---|---|---|---|---|---|---|---|
| (11) 1st Countercurrent Froth | 32 | 273 | 10.5 | 64 | 881 | 945 | 1.29 |
| (12) 3rd Countercurrent Tails | — | 251 | — | — | 838 | 838 | 1.20 |
| (13) Total Feed | 32 | 524 | — | 64 | 1719 | 1783 | 1.25 |
| Products | | | | | | | |
| (8) 2nd Countercurrent Tails | — | 340 | — | — | 1104 | 1104 | 1.23 |
| (14) 2nd Countercurrent Froth | 27 | 189 | 12.5 | 54 | 615 | 669 | 1.29 |
| 3rd Countercurrent Flotation Cells | | | | | | | |
| Feed Streams | | | | | | | |
| (14) 2nd Countercurrent Froth | 27 | 189 | 12.5 | 54 | 615 | 669 | 1.29 |
| (15) Water | — | 40 | — | — | 160 | 160 | 1.00 |
| (16) Crystallizer Muds (Barren Solution) | — | 126 | — | — | 430 | 430 | 1.17 |
| (17) Total Feed | 27 | 355 | — | 54 | 1205 | 1259 | 1.21 |
| Products | | | | | | | |
| (12) 3rd Countercurrent Tails | — | 251 | — | — | 838 | 838 | 1.20 |
| (18) 3rd Countercurrent Froth | 21 | 110 | 16 | 42 | 367 | 409 | 1.28 |
| Potash Flotation Circuit | | | | | | | |
| Feed Stream | | | | | | | |
| (6) Rougher Flotation Tails | 366 | 627 | 36.8 | 732 | 2023 | 2755 | 1.44 |
| Products | | | | | | | |
| (19) Potash Froth Product | 80 | 149 | 35 | 160 | 481 | 641 | 1.43 |
| (20) Potash Flotation Tails | 286 | 478 | 37.4 | 572 | 1542 | 2114 | 1.45 |
| Potash Froth Dewatering | | | | | | | |
| Feed Stream | | | | | | | |
| (19) Potash Froth Product | 80 | 149 | 35 | 160 | 481 | 641 | 1.43 |
| Products | | | | | | | |
| (21) Filtrate (Saturated Brine) | — | 142 | — | — | 458 | 458 | 1.24 |
| (25) Potash Cake | 80 | 7 | 92 | 160 | 23 | 183 | 1.90 |
| Potash Dryer | | | | | | | |
| Feed Stream | | | | | | | |
| (25) Potash Cake | 80 | 7 | 92 | 160 | 23 | 183 | 1.90 |
| Products | | | | | | | |
| (26) Standard Red Product | 66 | 0.3 | 99.5 | 132 | — | 132 | 2.00 |
| (27) Dryer Dust | 15 | 0.3 | 93 | 30 | — | 30 | 2.00 |
| (M) Water Vapor | — | 5.4 | — | — | 21 | 21 | 1.00 |
| Potash Flotation Tails Dewatering | | | | | | | |
| Feed Stream | | | | | | | |
| (20) Potash Flotation Tails | 386 | 478 | 37.4 | 572 | 1542 | 2114 | 1.45 |
| Products | | | | | | | |
| (22) Filtrate (Saturated Brine) | — | 453 | — | — | 1461 | 1461 | 1.24 |
| (34) Tails Cake | 286 | 25 | 92 | 572 | 81 | 653 | 1.91 |
| Dryer Dust Agitator | | | | | | | |
| Feed Stream | | | | | | | |
| (27) Dryer Dust | 15 | 0.3 | 98 | 30 | 1 | 31 | 2.00 |
| (28) Water | — | 62 | — | — | 248 | 248 | 1.00 |
| Product | | | | | | | |
| (29) Brine | — | 77.4 | — | — | 249 | 249 | 1.24 |
| Brine Balance | | | | | | | |
| Recovered Brine | | | | | | | |
| (23) Dewatering Circuits (21) & (22) | — | 595 | — | — | 1919 | 1919 | 1.24 |
| (10) 1st Countercurrent Tails | — | 375 | — | — | 1210 | 1210 | 1.24 |
| Total Brine Recovered (24) | — | 970 | — | — | 3129 | 3129 | 1.24 |
| Prepared Brine | | | | | | | |
| (29) Dryer Dust Agitator | — | 77 | — | — | 249 | 249 | 1.24 |
| Total Available Brine (24) & (29) | — | 1047 | — | — | 3378 | 3378 | 1.24 |
| Brine Distribution | | | | | | | |
| (31) Returned to Process (2) & (4) | — | 913 | — | — | 2945 | 2945 | 1.24 |
| (32) Routed to Crystallizer | — | 134 | — | — | 433 | 433 | 1.24 |
| Crystallizer Operation | | | | | | | |
| Feed Stream | | | | | | | |
| (32) Brine | — | 134 | — | — | 433 | 433 | 1.24 |
| Products | | | | | | | |
| (33) White Products | — | 8 | — | 16 | — | 16 | 2.00 |
| (16) Muds | — | 236 | — | — | 430 | 430 | 1.17 |

EXAMPLE V

The size of commercial flotation cells presently available range from 1 cubic foot to 2,000 cubic feet. Under these circumstances, it is necessary to calculate cell volume based on laboratory and/or pilot data for each particular installation. Example calculations for a potash recovery system as discussed previously are given below.

| Rougher Flotation Cells: | |
|---|---|
| Hourly Design Tonnage | 420 short tons of mine-run ore (400 short tons dry) |
| Flotation Time | 12 minutes |
| Percent Solids of Flotation Feed | 30 (undissolved) |
| Specific Gravity of Solids | 2.0 gms/cu. cm. |
| Specific Gravity of Brine | 1.24 gms/cu. cm. |

-continued

| | |
|---|---|
| Tons/Hr of Slurry | 400/.30 = 1333 |
| Tons/Hr of Brine | 1333 − 400 = 933 |
| GPM of Brine | $\frac{(933)(2000)}{(1.24)(8.33)(60)} = 3010$ |
| GPM of Solids | $\frac{(400)(4)}{2.0} = 800$ |
| GPM of Slurry | 3010 + 800 = 3810 |
| Cell Volume Required | 3010 × 12 minutes = 45,720 gals. |
| Flotation Cell Specified | 500 cu. ft. |
| Active Cell Volume | 3200 gallons/cell |
| Number of Flotation Cells Required | 45,720/3200 = 14.3 |
| To maintain circuit symmetry 16 cells would generally be utilized. | |
| Possible Arrangements: | |
| 4 rows having 4 cells each | |
| 2 rows having 8 cells each (preferred to prevent short circuiting of feed slurry) | |
| Flow Rates: | |
| 4 rows - 952 GPM of slurry each | |
| 2 rows - 1905 GPM of slurry each | |
| Products from Flotation: | |
| Rougher Froth (advanced to 1st countercurrent flotation cells) | 340 tons/hr. of slurry at 10% solids; 1055 GPM |
| Flotation Tails (feed to potash flotation circuit) | 993 tons/hr. of slurry at 36.8% solids; 2755 GPM |

EXAMPLE VI

| | |
|---|---|
| 1st Countercurrent Flotation Cells: | |
| Rougher Froth | 340 tons/hr of slurry at 10% solids; 1055 GPM |
| Counterflow of 2nd Countercurrent Tails | 340 tons/hr of solution at 1.23 gms/cu. cm. specific gravity; 1104 GPM |
| Total Flotation Feed | 680 tons/hr of slurry at 5% solids; 2159 GPM |
| Flotation Time | 15 minutes |
| Total GPM of Feed Slurry | 2159 |
| Total Volume Required | 2159 GPM × 15 minutes = 32,385 gals. |
| Flotation Cell Specified | 500 cu. ft. |
| Active Cell Volume | 3200 gals. |
| Number of Flotation Cells Required | 32,385/3200 = 10.1 |
| Arrangement | One row of 10 cells |
| Flow rate | 2159 GPM of slurry |
| Products from Flotation: | |
| 1st Countercurrent Froth (advanced to 2nd countercurrent flotation cells) | 305 tons/hr at 10.5% solids; 945 GPM |
| 1st Countercurrent Tails (advanced to subsequent processing for extraction of desired potash values) | 375 tons/hr at 1.24 specific gravity; 1210 GPM |

EXAMPLE VII

The recycle ratio r in Example VI would be calculated as follows:

340 tons/hr froth at 10% solids represents a liquid flow of 987 GPM.

340 tons/hr at 1.23 specific gravity represents a liquid flow of 1104 GPM.

Consequently, r = 1104/987 = 1.12

Having fully described my invention, it is to be understood that I am not limited to the details herein set forth but that my invention is of the full scope of the appended claims.

I claim:

1. A process for recovering soluble metallic values selected from the group consisting of copper, uranium, gold, silver, nickel, cobalt, zinc, aluminum, tungsten, titanium, antimony, barium and rhenium from a mixture comprising (A) said metallic values, (B) a solvent selected from the group consisting of (1) sulfuric acid, hydrochloric acid and ferric chloride when the metallic value is copper, (2) sulfuric acid and both sodium carbonate and sodium bicarbonate when the metallic value is uranium, (3) sodium cyanide when the metallic value is gold, (4) sodium cyanide, sodium hypochlorite and potassium hypochlorite when the metallic value is silver, (5) ammonia and ammonium carbonate when the metallic value is nickel, (6) sulfuric acid when the metallic value is cobalt, (7) sulfuric acid when the metallic value is zinc, (8) sodium hydroxide when the metallic value is aluminum, (9) hydrochloric acid when the metallic value is tungsten, (10) sulfuric acid and hydrochloric acid when the metallic value is titanium, (11) sodium sulfide or hydrochloric acid when the metallic value is antimony, (12) hydrofluoric acid and nitric acid when the metallic value is barium, (13) chlorine and sodium hypochlorite when the metallic value is rhenium, (C) at least one flotation reagent selected from the group consisting of collectors and modifiers, and (D) mineral impurities which are substantially insoluble in said selected solvent, said process comprising the steps of:

a. in a first flotation step, combining said mixture, with agitation, with a countercurrent tails stream from a second subsequent flotation step to thereby wash dissolved metallic values from said mineral impurities and dissolve undissolved metallic values;

b. floating the mineral impurities on the combined mixture to form a product solution of said metallic values and a first froth;

c. processing said product solution to yield said metallic values;

d. removing said first froth from said first flotation step and feeding it to the first of at least one subsequent flotation step wherein, in each subsequent flotation step, a froth from the preceding flotation step is mixed with a countercurrent stream to wash additional metallic values from said mineral impurities and dissolve additional undissolved metallic values, and a new froth and a countercurrent tails stream are formed, said countercurrent stream comprising the countercurrent tails stream from the next subsequent flotation step, and in the last subsequent flotation step, consisting of water, barren solution, said solvent for said metallic values or mixtures thereof; and e. controlling the concentration and flow rate of said countercurrent stream to maintain predetermined concentrations of the metallic values in the advancing countercurrent tails streams and in said product solution.

2. A process for recovering soluble copper values from a mixture comprising (A) said copper values, (B) a solvent comprising an aqueous solution of sulfuric acid, (C) a flotation reagent, comrising a collector comprising tertiary amine and diamine, and a modifier comprising citric acid, and (D) mineral impurities comprising plagioclase, quartz, hornblende, biotite and pyroxene, said process comprising the steps of:

a. in a first flotation step, combining said mixture, with agitation, with a countercurrent tails stream from a second subsequent flotation step to thereby wash dissolved copper values from said mineral impurities and dissolve undissolved copper values;

b. floating the mineral impurities on the combined mixture to form a product solution of said copper values and a first froth;

c. processing said product solution to yield said cooper values;

d. removing said first froth from said first flotation step and feeding it to the first of at least one subsequent flotation step wherein, in each subsequent flotation step, a froth from the preceding flotation step is mixed with a countercurrent stream to wash additional copper values from said mineral impurities and dissolve additional undissolved copper values, and a new froth and a countercurrent tails stream are formed, said countercurrent stream comprising the countercurrent tails stream from the next subsequent flotation step, and in the last subsequent flotation step, consisting of water, barren solution, said solvent for said copper values or mixtures thereof; and e. controlling the concentration and flow rate of said countercurrent stream to ainnain predetermined concentrations of the copper values in the advancing countercurrent tails streams and in said product solution.

3. The process of claim 2 wherein the collector comprises tertiary amine and diamine and the modifier comprises citric acid and hydrofluoric acid.

4. The process of claim 2 wherein the modifier comprises polyacrylamide and the collector comprises ethanolated alkyl guanidineamine.

5. A process for recovering soluble gold values from a mixture comprising (A) said gold values, (B) a solvent comprising an aqueous solution of cyanide, (C) a flotation reagent, comprising a collector comprising primary amine, and a modifier comprising iron sulfate and aluminum sulfate, (D) mineral impurities comprising plagioclase, quartz, hornblende, biotite and pyroxene, and (E) slime to maintain the basic pH, said process comprising the steps of:

a. in a first flotation step, combining said mixture, with agitation, with a countercurrent tails stream from a second subsequent flotation step to thereby wash dissolved gold values from said mineral impurities and dissolve undissolved gold values;

b. floating the mineral impurities on the combined mixture to form a product solution of said gold values and a first froth;

c. processing said product solution to yield said gold values;

d. removing said first froth from said first flotation step and feeding it to the first of at least one subsequent flotation step wherein, in each subsequent flotation step, a froth from the preceding flotation step is mixed with a countercurrent stream to wash additional gold values from said mineral impurities and dissolve additional undissolved gold values, and a new froth and a countercurrent tails stream are formed, said countercurrent stream comprising the countercurrent tails stream from the next subsequent flotation step, and in the last subsequent flotation step, consisting of water, barren solution, said solvent for said metallic values or mixtures thereof; and e. controlling the concentration and flow rate of said countercurrent stream to maintain predetermined concentrations of the gold values in the advancing countercurrent tails streams and in said product solution.

6. The process of claim 5 wherein the modifier comprises polyacrylamide and the collector comprises ethanolated alkyl guanidineamine.

7. A process for recovering metallic values from a mixture comprising (A) said metallic values, (B) a solvent for said values, (C) a flotation reagent, comprising a collector comprising polyacrylamide and a modifier comprising ethanolated alkyl guanidineamine, and (D) mineral impurities which are substantially insoluble in said solvent, said process comprising the steps of:

a. in a first flotation step, combining said mixture, with agitation, with a countercurrent tails stream from a second subsequent flotation step to thereby wash dissolved metallic values from said mineral impurities and dissolved undissolved metallic values;

b. floating the mineral impurities on the combined mixture to form a product solution of said metallic values and a first froth;

c. processing said product solution to yield said metallic values;

d. removing said first froth from said first flotation step and feeding it to the first of at least one subsequent flotation step wherein, in each subsequent flotation step, a froth from the preceding flotation step is mixed with a countercurrent stream to wash additional metallic values from said mineral impurities and dissolve additional undissolved metallic values, and a new froth and a countercurrent tails stream are formed, said countercurrent stream comprising the countercurrent tails stream from the next subsequent flotation step, and in the last subsequent flotation step, consisting, of water, barren solution, said solvent for said metallic values or mixtures thereof; and e. controlling the concentration and flow rate of said countercurrent stream to maintain predetermined concentrations of the metallic values in the advancing countercurrent tails streams and in said product solution.

8. In a process for recovering potash values from a mixture comprising water insoluble mineral impurities and said potash values, said process comprising the steps of (A) adding the mixture to an aqueous saturated solution of said potash values to form an admixture, (B) adding to the admixture at least one flotation reagent comprising a collector comprising ethanolated alkyl guidineamine, and a modifier comprising polyacrylamide to aid in flotation of the impurities, (C) floating the impurities in the aqueous solution, (D) removing the floated impurities containing entrained potash values from the admixture and processing the admixture to yield the undissolved potash values wherein the improvement comprises:

a. in a first flotation step, combining said mixture, with agitation, with a countercurrent tails stream from a second subsequent flotation step to thereby wash entrained potash values from said insoluble mineral impurities and dissolve entrained potash values in said countercurrent tails stream;

b. floating said insoluble mineral impurities on the combined mixture to form a product froth;

c. withdrawing said product solution from said first flotation step;

d. removing first said froth from said from said first flotation step and feeding it to the first of at least one subsequent flotation step wherein, in each subsequent flotation step, a froth from the preceding flotation step is mixed with a countercurrent stream to wash additional potash values from said mineral impurities and dissolve additional potash values, and a new froth and a countercurrent tails stream are formed, said countercurrent stream comprising the countercurrent tails stream from the next subseduent flotation step, and in the last subsequent flotation step, consisting of an unsaturated aqueous solution of said potash values, water, or mixtures thereof; and e. controlling the concentration and flow rate of said countercurrent stream to maintain predetermined concentrations of the mineral values in the advancing countercurrent tails stream and in said product solution from said flotation step.

* * * * *